US006686576B1

(12) United States Patent
Yang

(10) Patent No.: US 6,686,576 B1
(45) Date of Patent: Feb. 3, 2004

(54) WALL-MOUNTED TYPE MICROWAVE OVEN

(75) Inventor: Ha-Yeong Yang, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/317,069

(22) Filed: Dec. 12, 2002

(30) Foreign Application Priority Data

Sep. 14, 2002 (KR) ..... 2002-55987

(51) Int. Cl.[7] ..... H05B 6/80; F24C 15/20

(52) U.S. Cl. ..... 219/757; 126/299 R; 126/299 D; 219/391

(58) Field of Search ..... 219/757, 400, 219/391; 126/299 R, 299 D, 21 A

(56) References Cited

U.S. PATENT DOCUMENTS 3,011,492 A * 12/1961 Humbert ..... 126/299 R
3,356,008 A * 12/1967 Simpson et al. ..... 126/299 D
3,496,704 A * 2/1970 Bandlow ..... 96/138
5,986,245 A * 11/1999 Kang ..... 219/702

FOREIGN PATENT DOCUMENTS

| | | |
|---|---|---|
| EP | 0 337 935 | * 10/1989 |
| JP | 3-17458 | 1/1991 |
| JP | 5-126375 | * 5/1993 |

* cited by examiner

*Primary Examiner*—Philip H. Leung
(74) *Attorney, Agent, or Firm*—Staas & Halsey LLP

(57) ABSTRACT

A wall-mounted type microwave oven includes a guide device which guides steam and fumes generated therebelow toward an exhaust duct of the microwave oven. The guide device includes a plurality of guide pieces with gaps therebetween so as to bend the guide device in response to the guide device being pulled out of an oven body of the microwave oven. The guide pieces are connected to each other by corresponding link units. Each of the link units includes a pair of hinge pins fixed to the adjacent guide pieces, and a link connected to the adjacent hinge pins. Where the guide device is extended forwarded from the oven body, a front end of the guide device is bent forward and downward. Accordingly, an exhausting efficiently of the microwave oven is improved.

20 Claims, 3 Drawing Sheets

WALL-MOUNTED TYPE MICROWAVE OVEN

CROSS-REFERENCE TO RELATED APPLICATION

This application claims the benefit of Korean Patent Application No. 2002-55987, filed Sep. 14, 2002 in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven having a guide device which directs steam and fumes generated therebelow toward an exhaust duct of the microwave oven.

2. Description of the Related Art

Generally, a wall-mounted type microwave oven is installed on a kitchen wall above an oven range, and is provided therein with a hood motor and an exhaust duct to exhaust steam and fumes generated therebelow to the outside of the microwave oven.

Such a wall-mounted type microwave oven includes a guide device which directs the steam and fumes toward the exhaust duct. The guide device broadens an area to trap and guide the steam and fumes. That is, the guide device slides back and forth to cover, for example, a location of food being cooked by the oven range provided therebelow.

Typically, a conventional guide device of the wall-mounted type microwave oven has a plate-shaped structure. The plate-shaped guide device is operated so as to be is pulled out of a microwave oven body and retracted into the microwave oven body. The plate-shaped guide device is positioned to be parallel to a top surface of the oven range. Furthermore, the plate-shaped guide device is provided with smooth upper and lower surfaces, in which the lower surface faces the oven range.

In the conventional wall-mounted type microwave oven, the steam and fumes, which are generated from the oven range and rise upward during a cooking operation, are intercepted by the plate-shaped guide device. Some of the steam and fumes intercepted by the plate-shaped guide device are introduced into the exhaust duct of the microwave oven. However, the remaining steam and fumes are not introduced into the exhaust duct. This is because the remaining steam and fumes located near a region of the guide device where a suction force generated by a motor mounted on a hood is insufficient, are dispersed outwardly toward a cooking space.

SUMMARY OF THE INVENTION

Accordingly, an aspect of the present invention is to provide a wall-mounted type microwave oven, which is provided with a guide device having a curved surface so as to improve an exhaust efficiency of steam and fumes generated from food during a cooking operation.

Additional aspects and advantages of the invention will be set forth in part in the description which follows and, in part, will be obvious from the description, or may be learned by practice of the invention.

To achieve the above and/or other aspects of the present invention, there is provided a wall-mounted type microwave oven according to an embodiment of the present invention comprising an oven body, an exhaust duct provided in the oven body to exhaust fumes, and a guide device which is provided in the oven body and movably retracts and extends to and from the oven body, wherein the guide device bends forward and downward at a front end thereof so as to guide the fumes generated therebelow toward an inlet of the exhaust duct.

BRIEF DESCRIPTION OF THE DRAWINGS

These and other aspect and advantages of the present invention will become apparent and more readily appreciated from the following description of the embodiments, taken in conjunction with the accompanying drawings of which.

DETAILED DESCRIPTION OF THE EMBODIMENTS

Figure 1:
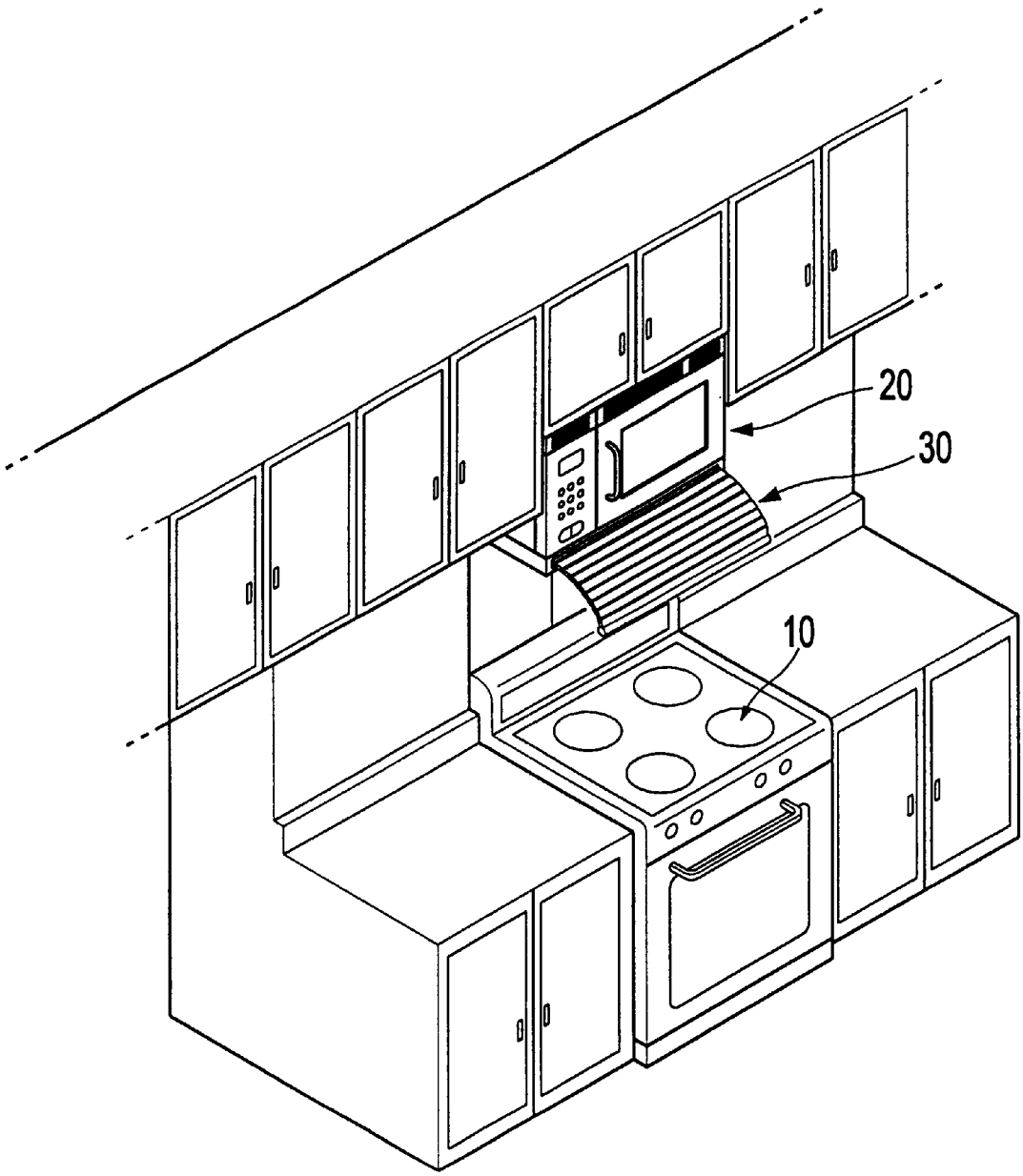
FIG. 1 is a perspective view of a wall-mounted type microwave oven having a guide device according to the present invention, in which the microwave oven is installed in a cooking space above an over range.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
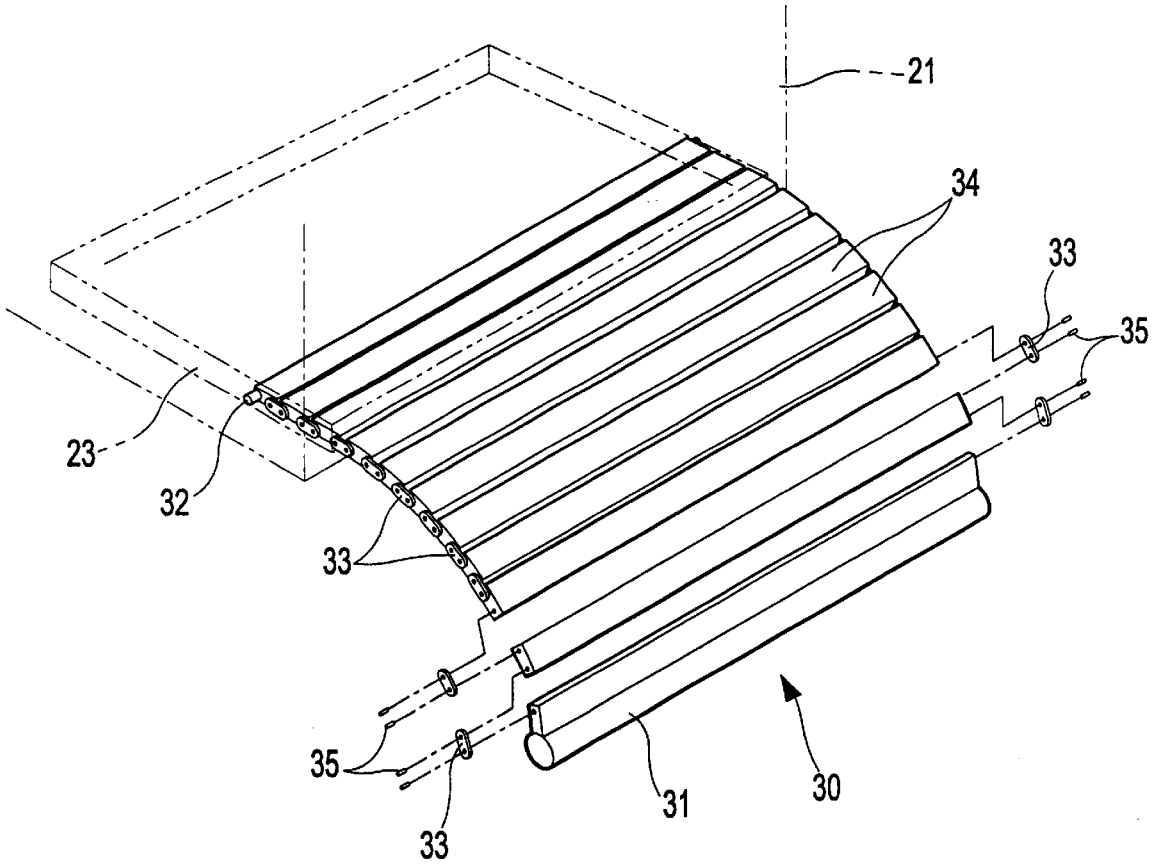
FIG. 2 is an exploded perspective view of the guide device shown in FIG. 1.
Figure 3:
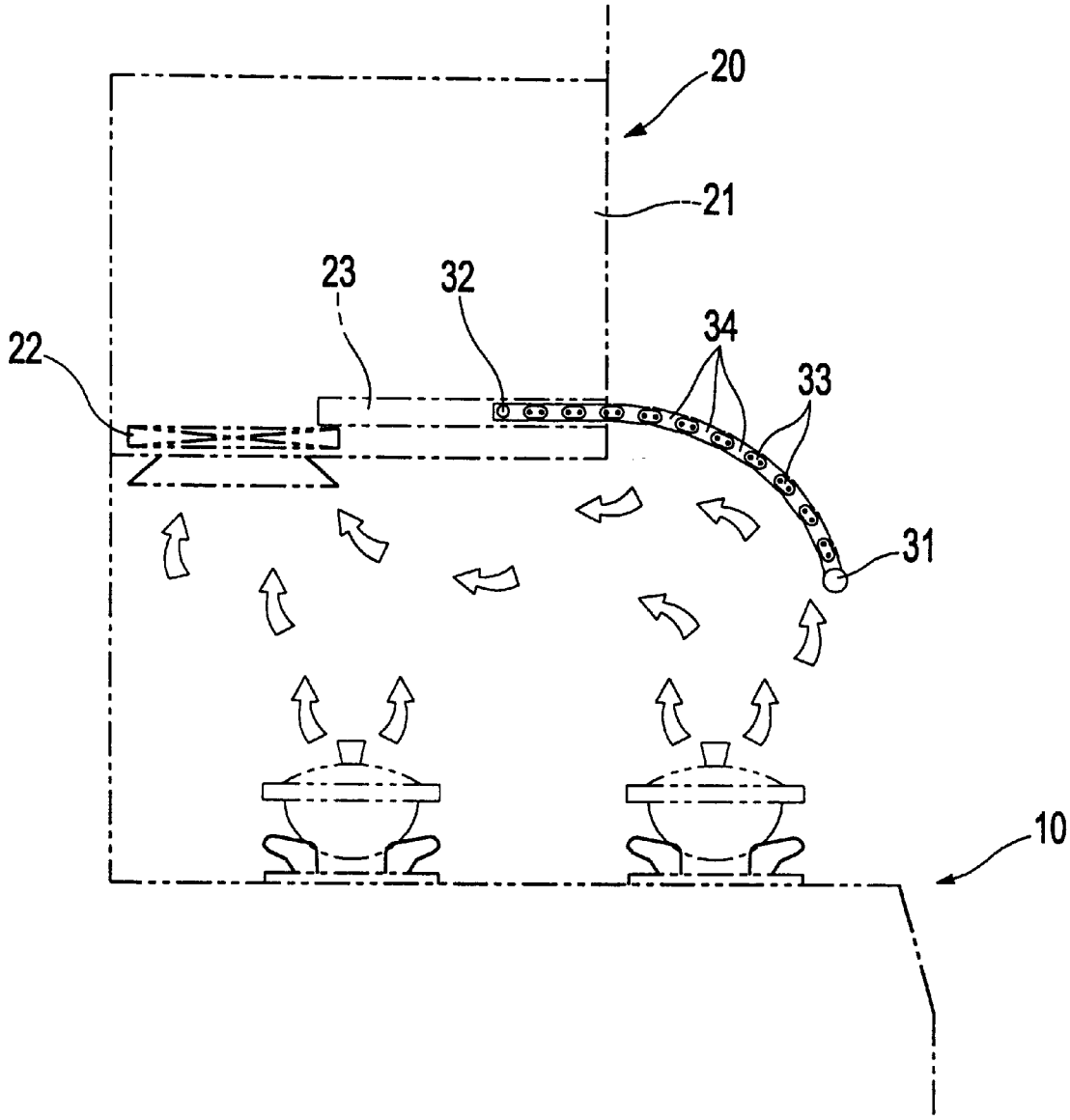
FIG. 3 is a side view of the guide device of FIG. 2, which is pulled out of a microwave oven body.

FIG. 1 shows a perspective view of a wall-mounted type microwave oven 20 having a guide device 30 according to the present invention. For example, the microwave oven is installed in a cooking space above an oven range 10. FIG. 2 is an exploded perspective view of the guide device 30 shown in FIG. 1, and FIG. 3 is a side view of the guide device 30, which is pulled out of a microwave oven body of the microwave oven 20.

The microwave oven 20 according to the present invention is provided with the guide device 30 which directs steam and fumes generated from the oven range 10, toward an exhaust duct 22 of the microwave oven 20. The guide device 30 is adapted to be received in a reception cavity 23 provided in a microwave oven body 21. The guide device 30 is provided at both sides thereof with stop protrusions 32 to prevent the guide device 30 from being separated from the reception cavity 23.

The guide device 30 is curved downward by its own weight as it is pulled out of the reception cavity 23. Referring to FIG. 2, the guide device 30 includes a plurality of guide bars 34, and a plurality of link units. Each of the link units comprises a link 33 and a pair of hinge pins 35. The hinge pins 35 are fixed to corresponding side surfaces of the guide bars 34.

The guide device 30 includes a grip 31 which is coupled to a foremost guide bar of the guide bars 34. The grip 31 is formed into a rod shape so as to allow a user to easily grasp the grip 31, and is properly weighted to prevent shaking of the guide device 30 where the guide device is pulled to extend forward.

For example, where the grip 31 is grasped by a user's hand and is pulled out of the oven body 21, the guide device 30 is extended forward from the oven body 21. At this point, the guide device 30 is somewhat bent downward with respect to a horizontal plane of the oven body 21, as the guide bars 34 are connected to each other with gaps therebetween.

Where a cooking is performed by the oven range 10 with the guide device 30 being extended forward, since a front end of the guide device 30 is directed forward and downward and a rear end of the guide device 30 is directed toward the exhaust duct 22, steam and fumes generated from the oven range 10 are efficiently guided toward an inlet of the exhaust duct 22.

As illustrated in FIG. 3, the steam and fumes, which are guided to the inlet of the exhaust duct 22 by the guide device, are introduced into the exhaust duct 22 by a suction force generated by a motor (not shown) provided in the exhaust duct 22, and then discharged to the outside of the cooking space through the exhaust duct 22. However, it is understood that the exhaust duct 22 could be moved towards the front of the oven or in other positions.

As described above, the present invention provides a wall-mounted type microwave oven having a guide device which bends forward and downward at a front end thereof in response to being pulled out of an oven body of the microwave oven. A rear end of the guide device is directed toward an exhaust duct of the microwave oven. Accordingly, steam and fumes generated by an oven range provided below the microwave oven are guided toward an inlet of the exhaust duct. The bendable feature of the guide device improves an exhausting efficiency of the microwave oven. However, a rigid curved device could also be used so long as the curved position is extendable over the oven range to guide steam and fumes.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted type microwave oven, comprising:

an oven body;

an exhaust duct provided in the oven body to exhaust fumes; and a guide device having a plurality of guide bars with gags therebetween, which is provided in the oven body and movably retracts and extends to and from the oven body, wherein the guide device bends forward and downward at a front end thereof in response to being extended so as to guide the fumes generated therebelow toward an inlet of the exhaust duct.

2. The wall-mounted type microwave oven as set forth in claim 1, wherein the guide device further comprises:

a plurality of link units, wherein each link unit connects the corresponding adjacent guide bars.

3. The wall-mounted type microwave oven as set forth in claim 2, wherein each of the link units comprises:

a pair of hinge pins which are fixed to side surfaces of the corresponding adjacent guide bars; and a link which is hingedly connected to the pair of hinge pins.

4. The wall-mounted type microwave oven as set forth in claim 2, further comprising a grip provided at a foremost guide bar of the guide bars.

5. The wall-mounted type microwave oven as set forth in claim 4, wherein the grip has a rod shape.

6. The wall-mounted type microwave oven as set forth in claim 1, further comprising a reception cavity which is provided in the oven body and receives the guide device, wherein the guide device includes one or more stop protrusions which prevent a separation of the guide device from the reception cavity.

7. A mountable cooking apparatus, comprising:

an oven body;

a heating unit disposed in the oven body so as to cook food;

an exhaust duct provided in the oven body to exhaust fumes; and a guide device which retracts and extends to and from the oven body, the guide device having a plurality of guide bars with gaps therebetween, which curves as the guide device is extended forward from the oven body so as to define a shape which guides the fumes generated therebelow toward an inlet of the exhaust duct.

8. The mountable cooking apparatus as set forth in claim 7, wherein:

the guide device bends downward along a curved path of the shape in response to being extended forward from the oven body, so as to improve a guiding efficiency of the guide device to guide the fumes, and the curved surface return to an original surface condition of the guide device in response to the guide device being retracted into the oven body.

9. The mountable cooking apparatus as set forth in claim 7, wherein the guide device further comprises:

a plurality of link units, wherein each link unit connects the corresponding adjacent guide bars.

10. The mountable cooking apparatus as set forth in claim 9, wherein each of the link units comprises:

a pair of hinge pins which are fixed to side surfaces of the corresponding adjacent guide bars; and a link which is hingedly connected to the pair of hinge pins.

11. The mountable cooking apparatus as set forth in claim 9, further comprising a grip provided at a foremost guide bar of the guide bars.

12. The mountable cooking apparatus as set forth in claim 7, wherein the heating unit includes a magnetron which generates microwaves to cook the food.

13. The mountable cooking apparatus as set forth in claim 7, wherein the cooking apparatus is a wall-mountable microwave oven.

14. The mountable cooking apparatus as set forth in claim 7, wherein the guide device is curved down by a weight thereof in response to being pulled out from the oven body.

15. An exhaust guiding apparatus of a mountable cooking unit having an oven body, a heating unit, and an exhaust duct which exhausts fumes therebelow to the outside of the cooking unit, the exhaust guiding apparatus comprising:

a guide plate device having a plurality of guide bars with gaps therebetween, which movably extends to and from the oven body, and forms a curved path which guides the fumes generated therebelow toward the exhaust duct; and a reception cavity which houses the guide plate device.

16. The exhaust guiding apparatus of a mountable cooking unit as set forth in claim 15, wherein the guide plate device has a surface which curves as the guide plate device is extended forward from the oven body.

17. The exhaust guiding apparatus of a mountable cooking unit as set forth in claim 15, wherein:

the guide plate device bends downward along in response to being extended forward from the oven body, so as to improve a guiding efficiency of the guide plate device to guide the fumes, and the curved surface return to an original surface condition of the guide plate device in response to the guide device being retracted into the oven body.

18. The exhaust guiding apparatus of a mountable cooking unit as set forth in claim 15, wherein the guide plate device further comprises:

a Plurality of link units, wherein each link unit connects the corresponding adjacent guide bars.

19. The exhaust guiding apparatus of a mountable cooking unit as set forth in claim 18, wherein each of the link units comprises:

a pair of hinge pins which are fixed to side surfaces of the corresponding adjacent guide bars; and a link which is hingedly connected to the pair of hinge pins.

20. The exhaust guiding apparatus of a mountable cooking unit as set forth in claim 18, further comprising a grip provided at a foremost guide bar of the guide bars.

* * * * *